US011370087B2

(12) United States Patent
Birkeland

(10) Patent No.: US 11,370,087 B2
(45) Date of Patent: Jun. 28, 2022

(54) PINNING TOOL FOR PINNING A TUBULAR STRUCTURE

(71) Applicant: Smart Installations AS, Tananger (NO)

(72) Inventor: Petter Birkeland, Tananger (NO)

(73) Assignee: Smart Installations AS, Tananger (NO)

( * ) Notice: Subject to any disclaimer, the term of this patent is extended or adjusted under 35 U.S.C. 154(b) by 97 days.

(21) Appl. No.: 17/040,907

(22) PCT Filed: Apr. 11, 2019

(86) PCT No.: PCT/NO2019/050080

§ 371 (c)(1),
(2) Date: Sep. 23, 2020

(87) PCT Pub. No.: WO2019/209113

PCT Pub. Date: Oct. 31, 2019

(65) Prior Publication Data

US 2021/0031334 A1 Feb. 4, 2021

(30) Foreign Application Priority Data

Apr. 23, 2018 (NO) ..... 20180560

(51) Int. Cl.
*B25B 5/00* (2006.01)
*B25B 5/14* (2006.01)

(52) U.S. Cl.
CPC ..... *B25B 5/147* (2013.01)

(58) Field of Classification Search
CPC ..... F16L 55/1003; F16L 1/166; F16L 21/00; Y10T 137/6123; B25B 27/14; B25B 5/147
See application file for complete search history.

(56) References Cited

U.S. PATENT DOCUMENTS 3,817,271 A * 6/1974 Roven ..... F16L 41/06 285/197
4,007,705 A 2/1977 Sherer et al.
(Continued)

FOREIGN PATENT DOCUMENTS

EP 1084798 3/2001
EP 2447463 5/2012
(Continued)

OTHER PUBLICATIONS

Norwegian Search Report for No. 20180560, dated Nov. 23, 2018.
International Search Report and the Written Opinion for PCT/NO2019/050080, dated Jul. 10, 2019.

*Primary Examiner* — Lee D Wilson
(74) *Attorney, Agent, or Firm* — Andrus Intellectual Property Law, LLP

(57) ABSTRACT

A pinning tool is for pinning a tubular structure by pressing a pin through a sidewall of the tubular structure. The pinning tool comprises: a tool body configured for receiving the tubular structure; an actuator mounted on the tool body, the actuator being provided with a piston rod, wherein the actuator is configured for displacing the piston rod in a translational movement; a pin adaptor releasably coupled to the piston rod of the actuator and being configured for receiving and releasably holding the pin to be pressed through and remain in the sidewall of the tubular structure, and a reaction member for fixing a relative position between the tool body and the tubular structure during pinning, wherein the translational movement of the piston rod causes displacement of the pin adaptor, thereby pressing, in operational use, the pin through the sidewall of the tubular structure.

12 Claims, 6 Drawing Sheets

(56) References Cited

U.S. PATENT DOCUMENTS

| | | | | |
|---|---|---|---|---|
| 5,722,142 | A * | 3/1998 | Myers | B25B 7/02 29/268 |
| 6,718,870 | B1 | 4/2004 | Frenken | |
| 7,351,010 | B1 | 4/2008 | Kelly et al. | |
| 9,655,310 | B1 * | 5/2017 | Hemstedt | A01G 25/026 |
| 2003/0015322 | A1 | 1/2003 | Fotland et al. | |
| 2005/0194000 | A1 * | 9/2005 | Todack | B28D 1/222 125/23.01 |
| 2012/0291606 | A1 | 11/2012 | Khoury et al. | |
| 2013/0146305 | A1 | 6/2013 | Dupal et al. | |
| 2013/0220436 | A1 * | 8/2013 | Sharp | B23D 21/006 137/15.01 |
| 2021/0031334 | A1 * | 2/2021 | Birkeland | E21B 19/00 |

FOREIGN PATENT DOCUMENTS

| | | |
|---|---|---|
| GB | 2528664 | 2/2016 |
| WO | 2008032341 | 3/2008 |

* cited by examiner

PINNING TOOL FOR PINNING A TUBULAR STRUCTURE

CROSS-REFERENCE TO RELATED APPLICATIONS

This application is the U.S. national stage application of International Application PCT/NO2019/050080, filed Apr. 11, 2019, which international application was published on Oct. 31, 2019, as International Publication WO 2019/209113 in the English language. The International Application claims priority of Norwegian Patent Application No. 20180560, filed Apr. 23, 2018. The international application and Norwegian application are both incorporated herein by reference, in entirety.

FIELD

The invention relates to a pinning tool for penetrating a pin through a sidewall of a tubular structure, such as a casing. The invention further relates to a combined pinning tool and cutting tool for penetrating the pin through the sidewall of the tubular structure and cutting the tubular structure. The invention also relates to a method for pinning a tubular structure using the pinning tool.

BACKGROUND

During operations on an oil rig there is sometimes required to cut tubular structures, such as casings, drill strings, production tubing and risers. Typically, the tubular structures are cut in short sections for easier handling. After cutting, the tubular structures are usually lifted away from the drill floor. A commonality with many of the tubular structures being cut is that they often comprise several pipes positioned within each other, pipe-in-pipe. There is a risk that one or several pipes within another pipe may slide or fall out after being cut and then lifted.

There has been developed techniques for drilling a hole through the pipes and inserting a bolt prior to cutting to avoid the abovementioned risk. This technique is known as pinning. The problem with this way of pinning pipes is that it is time consuming. Thus, there is a need for faster pinning techniques.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates more particularly to a pinning tool for pinning a tubular structure by pressing a pin through a sidewall of the tubular structure, the pinning tool comprising:

- a tool body configured for receiving the tubular structure;
- an actuator mounted on the tool body, the actuator being provided with a piston rod, wherein the actuator is configured for displacing the piston rod in a translational movement;
- a pin adaptor releasably coupled to the piston rod of the actuator and being configured for receiving and holding the pin to be pressed through and remain in the sidewall of the tubular structure, and
- a reaction member for fixing a relative position between the tool body and the tubular structure during pinning, wherein the translational movement of the piston rod causes displacement of the pin adaptor, thereby pressing, in operational use, the pin through the sidewall of the tubular structure.

Pinning (drilling a hole through the tubular structure and treading a pin through the hole) is a known term in the technical field of oil and gas recovery. The invention effectively defines pressing a pin through a sidewall of the tubular structure (which remains) as pinning. The effect of the pinning tool in accordance with the invention is as follows. In operational use of the pinning tool the pin is placed on and held by the pin adaptor. Subsequently the tubular structure is received by the tool body and the actuator is used to press the pin through the tubular structure. The (hydraulic) actuator that is known from cutting tools conveniently provides very high forces and the inventor realized that this effect may be conveniently used for pinning. Contrary to the known pinning technique of drilling a hole and treading a pin through the hole, the pinning operation in accordance with the invention may be carried out much faster, typically in the order of 5-10 minutes.

It should be understood that the invention is not limited to pressing the pin through only one sidewall of the tubular structure. However, the pin may be pressed through the entire tubular structure, and several tubular structures positioned within each other.

In an embodiment, a longitudinal axis of the tubular structure should be substantially perpendicular to a direction of the translational movement during pinning. However, this should not be considered to restrict the pinning tool from operating at different angles between the longitudinal axis of the tubular structure and the direction of the translational movement. A further effect of the invention is that the pin may restrict tubular structures positioned within a larger tubular structure from sliding and/or rotating relative to the outer tubular structure. The pin may also be used as a lifting point.

In an embodiment, the actuator, the pin adaptor and the tool body may be arranged such that, in operational use when the pin is provided on and held by the pin adaptor, the pin penetrates through the sidewall, wherein a longitudinal axis of the pin is substantially parallel to a direction of the translational movement. Aligning the pin parallel to the direction of the translational movement has the effect that the risk of damaging, such as breaking or bending, the pin during pinning is reduced. In a preferred embodiment, the longitudinal axis of the pin may be aligned with a longitudinal axis of the piston rod. This has the effect that the force from the actuator is transferred in a straight line through the piston rod and the pin, thus not inducing any bending moment in the pin, pin adaptor or piston rod.

In an embodiment the pin is provided on and held by the pin adaptor. In the pinning process of the current invention the pin is pressed through (penetrating) the sidewall of the tubular structure and remains there. This means that the pinning tool of the invention may be sold without the pin. The pin is typically releasably coupled to the pin adaptor in operational use of the pinning tool. In this embodiment the pin has been provided to the pinning tool.

In an embodiment, the pin may be provided with a projection extending helically about the longitudinal axis. The helical projection may cause the pin to rotate about the longitudinal axis as it is penetrating the tubular structure.

This embodiment should not be understood as the pin being actively rotated by for example a motor while it is penetrating the tubular structure. The rotation is merely an effect of the penetration itself. One effect of the pin rotation is that the pin may penetrate the sidewall of the tubular structure more easily, i.e. with less axial force.

In an embodiment, a first end portion of the pin may be replaceable. This embodiment of the invention has the effect that the first end portion, for example a tip of the pin, may be replaced to suite the tubular structure to be pinned. For example, the first end portion should have a higher yield strength than the tubular structure to avoid yielding the pin during pinning. Thus, for a tubular structure of a high-grade material, the first end portion may be replaced with one having an even higher-grade material than the tubular structure. In one embodiment, the entire pin may be fabricated from a material having a higher grade than the material of the tubular structure.

In an embodiment, a position of the pin adaptor relative to the tubular structure may be adjustable in a transverse direction orthogonal to the longitudinal axis. Adjusting a transverse position of the pin adaptor with respect to the tubular structure has the effect that the pin entry point in the sidewall of the tubular structure may be adjusted. This may be advantageous if there are one or more pipes eccentrically positioned within the outer pipe. Thus, to ensure that the pin penetrates all the pipes it may be required to adjust the transverse position of the adaptor.

In an embodiment, the reaction member may be hinged to the tool body, and, in a closed position, enveloping the tubular structure. Hinging the reaction member to the tool body has the effect that it may be swung out of the way when positioning the pinning tool adjacent the tubular structure. Upon positioning, the reaction member may be swung in and connected to the tubular structure to fix the relative position between the pinning tool and the tubular structure.

The reaction member may envelop the tubular structure. Enveloping the tubular structure may be understood as surrounding or enfolding the tubular structure. One effect of enveloping the tubular structure is that it creates firm anchoring between the pinning tool and the tubular structure.

In an embodiment, the tubular structure is one of the group consisting of: a casing, a conductor, a drill string, a production tubing, and a riser. These tubular structures are the most conventional types that may need to be pinned during operations on an oil rig. It should be noted that the invention also facilitates pinning of multiple tubular structures positioned within each other and having cement in between them. This may be particularly relevant for a casing or conductor having one or multiple casings or tubing inside, as the annular space in between these are often cemented.

In a second aspect the invention relates more particularly to a combined pinning tool and cutting tool for pinning and cutting the tubular structure, said combined tool comprising:

- the pinning tool according to any of the preceding claims;
- a non-rotatable cutting element connected to the piston rod;
- a second reaction member for applying a reaction force on the tubular structure during cutting.

The combined pinning and cutting tool has the effect that a pinning operation and a cutting operation may be performed by the same tool, and much faster than the conventional techniques allow for. Said combined tool may have two modes of operation, one pinning mode and one cutting mode. Cutting may be performed by a second translational movement of the piston rod.

In an embodiment the second reaction member may be hinged to the tool body and comprises a second cutting element directed towards, in an operational position, the non-rotatable cutting element for facilitating the cutting. The effect of hinging the second reaction member to the tool body is that, in the pinning mode, the second reaction member may be swung out of the way. Thus, depending on what mode of operation is required, pinning or cutting, the relevant reaction member may be selected.

The effect of having a further cutting element on the second reaction member is that the cutting may be carried out quicker, thus reducing cutting time. In one embodiment, the second reaction member may be configured such that in the operational position, i.e. closed position, a distance between a longitudinal axis of the tubular element and the piston rod is reduced compared to the said distance in pinning mode. Thus, a stroke of the piston rod may be similar in both pinning mode and cutting mode.

In a third aspect the invention relates more particularly to a method for pinning the tubular structure, by means of the pinning tool in accordance with any of the claims 1 to 8, the method comprising the following steps:

- providing the pinning tool with a pin releasably held by the pin adaptor;
- positioning the pinning tool adjacent the tubular structure;
- fixing the position of the pinning tool relative to the tubular structure;
- activating the pinning tool for pressing the pin through the sidewall of the tubular structure by carrying out the translational movement of the piston rod of the actuator, and
- releasing the pin from the pin adaptor.

The effect of pinning a tubular structure according to this embodiment of the invention is that the pinning may be carried out much faster compared to the conventional technique of drilling through the tubular structure.

In an embodiment, in the step of positioning the pinning tool, the positioning comprises adjusting a position of the pin adaptor relative to the tubular structure in a transverse direction orthogonal to the longitudinal axis. The pinning tool of this embodiment of the invention provides means for ensuring that the pin may penetrate internal tubular structures eccentrically positioned with respect to the outer tubular structure.

BRIEF DESCRIPTION OF THE FIGURES

In the following is described an example of a preferred embodiment illustrated in the accompanying drawings, wherein.

DETAILED DESCRIPTION OF THE FIGURES

Figure 1:
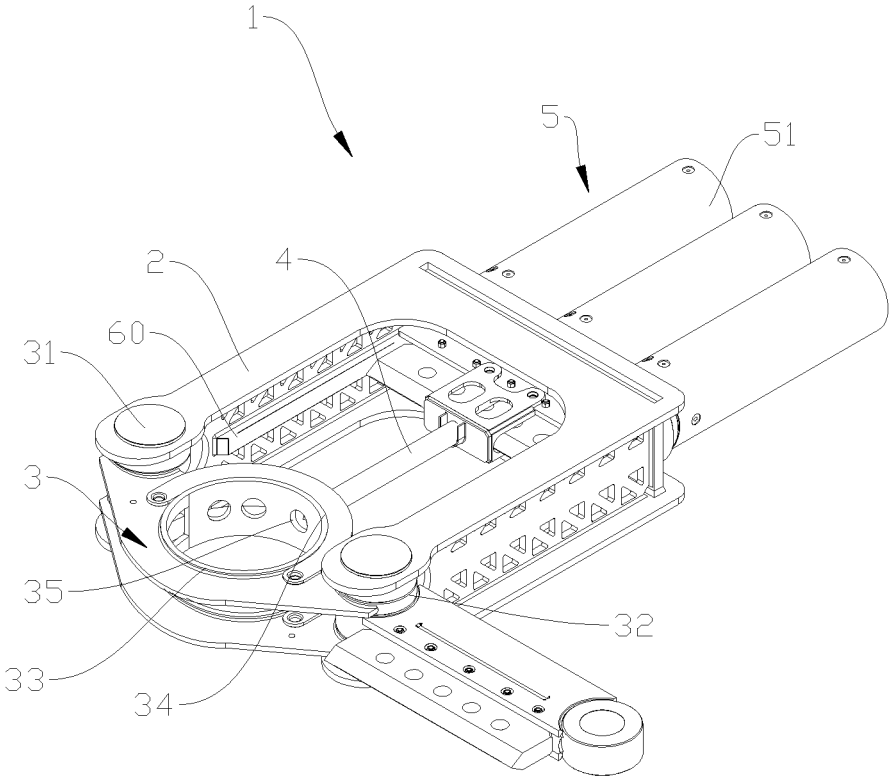
FIG. 1 shows a perspective view of a pinning tool according to one embodiment of the invention.

In the figures and detailed description only one example of a pinning tool is given. It must be stressed that the invention is not limited to this example. FIG. 1 shows a perspective view of an embodiment of a pinning tool 1 in accordance with the invention. The pinning tool 1 may be installed on the drill floor as a mount onto a roughneck (not shown) or as a stand-alone system (not shown), which may be run back and forth (for instance using a rail system) over a Rotary Kelly Bushing (RKB) for each pinning operation. Alternatively, it may be manipulated by means of a crane or manipulator (not shown).

FIG. 1 shows the pinning tool 1 comprising a tool body 2. A rotatable reaction member 3 is mounted on the tool body 2. The reaction member 3 may be selectively opened or closed. The reaction member 3 comprises a first enveloping element 33 and a second enveloping element 34 forming an enclosure 30 (see FIG. 2) for receiving a tubular structure 8 (see FIG. 4B). The second enveloping element 34 is connectable to the first enveloping element 33.

The reaction member 3 is connected to the tool body 2 by a hinging mechanism 32. In a closed position, the reaction member 3 may be locked in place by a locking bolt 31 insertable through the tool body 2 and the reaction member 3.

In the closed position, the reaction member 3 fixes a relative position between the tool body 1 and the tubular structure 8. An inner diameter D (see FIG. 2) of the enveloping elements 33, 34 may be adjusted by inserts to match an outer diameter of the relevant tubular structure 8 and provide firm anchoring between the pinning tool 1 and the tubular structure 8.

The second enveloping element 34 is provided with a hole 35 for letting a pin 4 pass through. The first enveloping element 33 may also be provided with a similar hole (not shown).

FIG. 1 further shows the pinning tool 1 comprising an actuator 5. In this specific embodiment, the pinning tool 1 is provided with three actuators 5. The actuator 5 comprises a housing 51 and a piston rod 52 (see FIG. 3). The actuator 5 is operated by hydraulic pressure to displace the piston rod 52. The actuator 5 is configured to deliver a considerable amount of axial force, for example 1000 tons.

Figure 3:
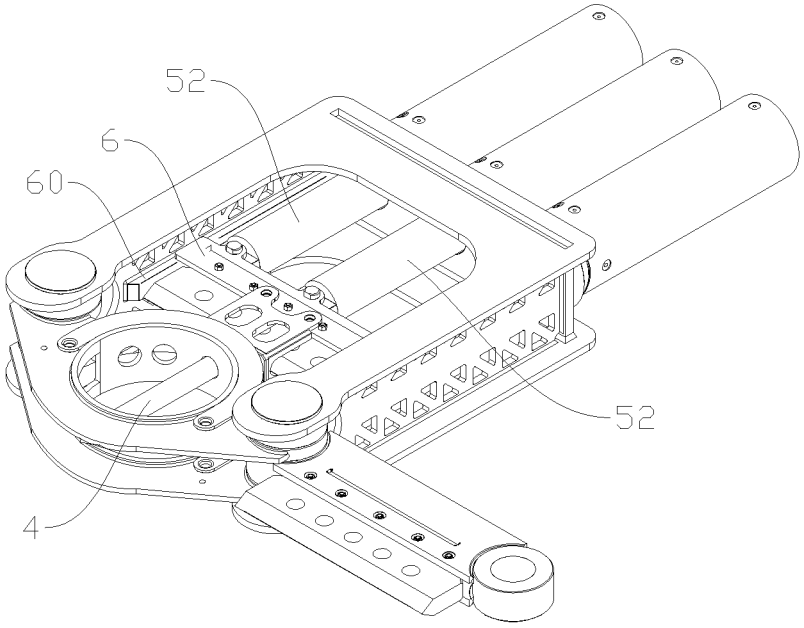
FIG. 3 shows a perspective view of the pinning tool in an engaged position.

Each piston rod 52 is coupled to a common bracket 6 (see FIG. 3). As the actuators 5 extend the piston rods 52 towards the reaction member 3, the bracket 6 is guided along a track 60 on the tool body 2 for support.

Figure 2:
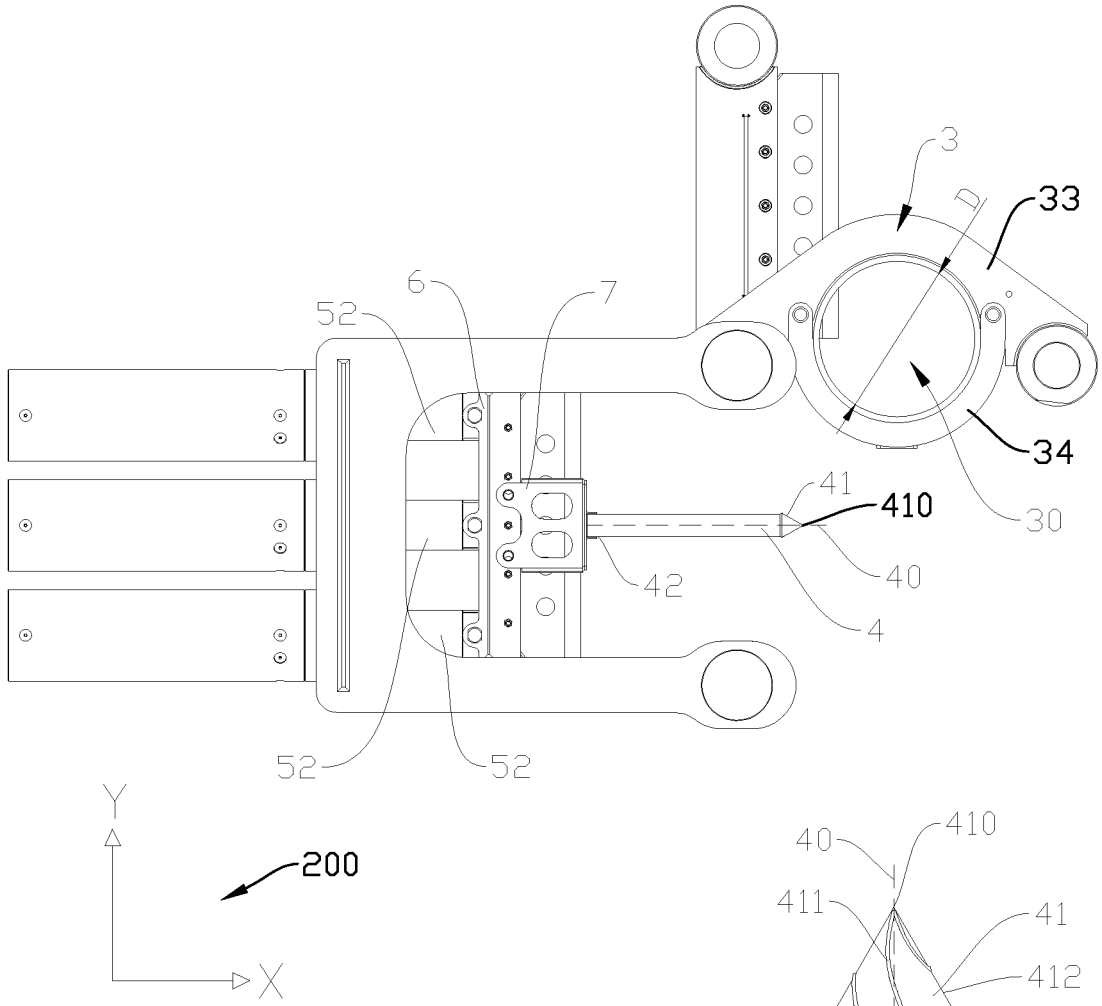
FIG. 2 shows a plane view of the pinning tool with a reaction member in an open position.

FIG. 2 shows a pin adaptor 7 coupled to the common bracket 6. The pin adaptor 7 is connectable to the common bracket 6 by means of for example bolts. A transverse position of the pin adaptor 7 relative to the bracket 6 is adjustable. A transverse direction corresponds to the Y-direction illustrated by the X-Y coordinate system 200. Adjusting the transverse position of the pin adaptor 7 may be required to ensure that the pin 4 is pressed through (=penetrates) the tubular structure 8 at a desired location, such as through a center of the tubular structure 8. The pin adaptor 7 is configured to receive and support the pin 4. A longitudinal axis 40 of the pin 4 is shown to be arranged parallel to piston rods 52, and thus parallel to the direction of the translational movement of the piston rods 52.

A first end portion 41 of the pin 4 is configured with a pointed tip 410 to penetrate a sidewall 80 of the tubular structure 8 more easily. The first end portion 41 may have different embodiments, only one is shown in the figures. In one embodiment, the first end portion 41 is removable. This enables replacing the first end portion 41 of the pin 4, for example with a first end portion 41 made from a higher-grade material.

Figure 2A:
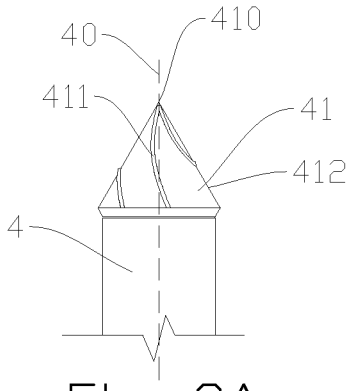
FIG. 2A shows a portion of a pin according to one embodiment of the invention.

A second end portion 42 of the pin 4 is connectable to the pin adaptor 7. In one embodiment, the pin 4 may be fixed to the pin adaptor 7. In another embodiment, the pin 4 may be rotatably connected to the pin adaptor 7. A rotatable connection allows the pin 4 to rotate as it is pressed through the tubular structure 8. FIG. 2*a* shows a portion of an embodiment of the pin 4 comprising a projection 411 extending helically about the longitudinal axis 40. The helical projection 411 projects from an outer surface 412 of the first end portion 41 of the pin 4. The projection 411 may cause the pin 4 to rotate as it is pressed through the tubular structure 8. The rotation may reduce a required axial force to drive the pin 4 through the tubular structure 8.

In FIG. 2 the piston rods 52 are shown to be partially extended and the reaction member 3 is in the open position. In FIG. 3 the piston rods 52 are shown to be fully extended and the reaction member 3 is in the closed position. With the piston rods 52 fully extended, the pin 4 cross through the enclosure 30.

Figure 4:
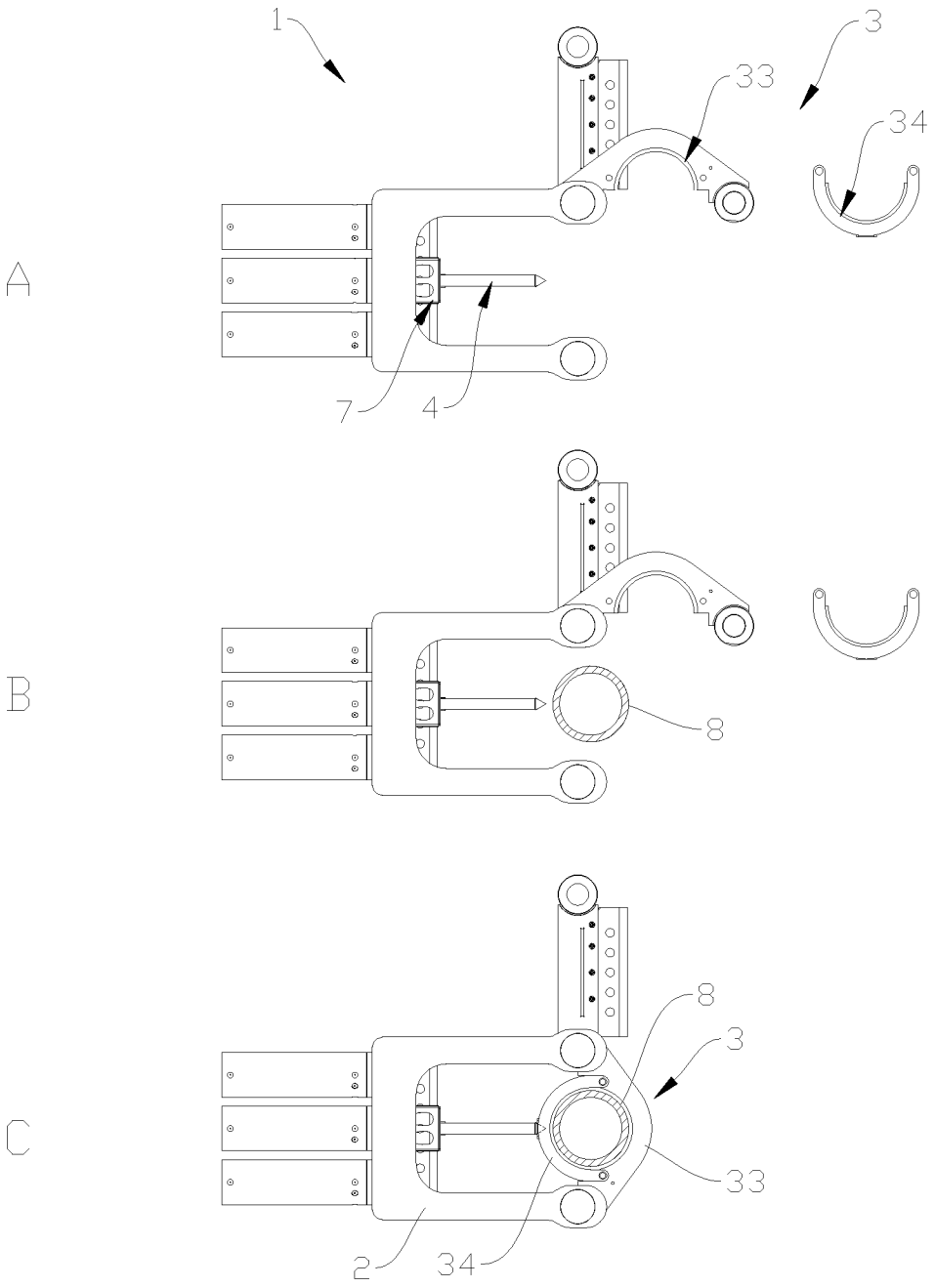
FIG. 4A-E shows, in a smaller scale than FIG. 2, in a simplified manner the various steps of a pinning operation using the pinning tool.
Figure 4:
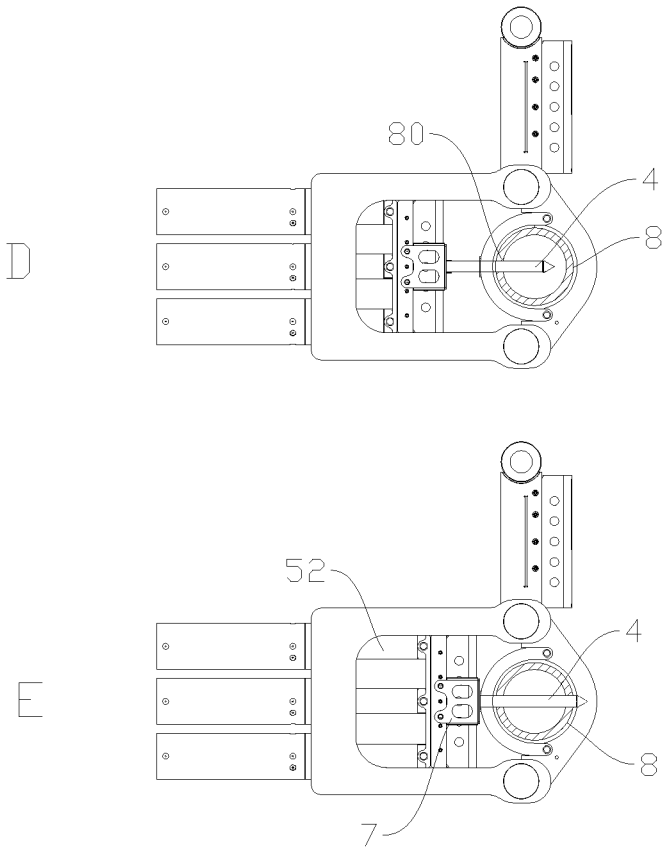

FIGS. 4 and 5 shows a pinning operation in simplified steps. FIG. 4A shows the pinning tool 1 in a starting position, wherein the reaction member 3 is in the open position and the second enveloping element 34 is disconnected from the first enveloping element 33. The piston rods 52 are in a retracted position and the pin 4 is mounted on the pin adaptor 7.

FIG. 4B shows the pinning tool 1 positioned adjacent a tubular structure 8, such as a casing. In FIG. 4C the reaction member 3 is rotated to the closed position and the second enveloping element 34 is connected to the first enveloping element 33 to fix the relative position of the tubular structure 8 relative to the tool body 2. The pinning tool 1 is now ready to pin the tubular structure 8.

FIG. 4D shows the pin 4 pressed through the sidewall 80 of the tubular structure 8. FIG. 4E shows the pin 4 fully pressed through the tubular structure 8. After pinning, the pin 4 is disconnected from the pin adaptor 7, leaving the pin 4 in the tubular structure 8 while the piston rods 52 are retracted.

Figure 5A:
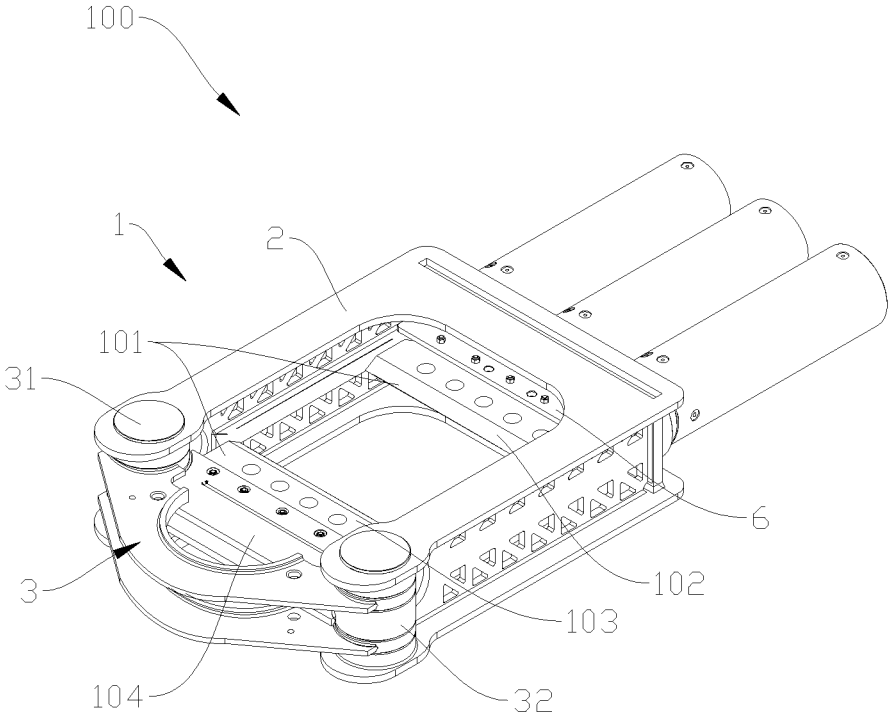
FIG. 5A shows, in the same scale as FIG. 1, a combined pinning and cutting tool according to one embodiment of the invention.

FIG. 5A shows a combined pinning and cutting tool 100. The combined tool 100 comprises the pinning tool 1 as previously described and a cutting tool 101. As may be seen from the previous figures, the pinning tool 1 is depicted comprising the cutting tool 101. However, it is important to note that the pinning tool 1 does not require the cutting tool 101 to function, it is merely for illustration purposes. The cutting tool 101 comprises two cutting blades 102, 103. A first cutting blade 102 mounted on the common bracket 6 and a second cutting blade 103 mounted on a second independently rotatable reaction member 104. The second rotatable reaction member 104 is hinged to the tool body 2 and may be selectively opened or closed, independently of the reaction member 3 used for pinning. The second rotatable reaction member 104 may be locked in a closed position by the locking bolt 31.

The tubular structure 8 is cut by the translational movement of the piston rods 52, displacing the first cutting blade 102 towards the second cutting blade 103. The second cutting blade 103 reduces the required time to perform the cut. Cutting may be performed after the tubular structure 8 has been pinned. The cutting blades 102, 103 may be arranged such that they cut through the tubular structure 8 at a different elevation than where the pin 4 is located. Alternatively, the cutting blades 102, 103 may be arranged at the same elevation as the pin 4. However, between pinning and cutting, the tubular structure 8 is lifted or lowered relative to the tool body 2 such that the cut is performed at a different elevation from where the pin 4 is located.

In a situation where several tubular structures are positioned within each other (not shown), pinning the tubular structures prior to cutting may prevent an inner tubular structure from dropping or sliding relative to an outer tubular structure after cutting.

Figure 5B:
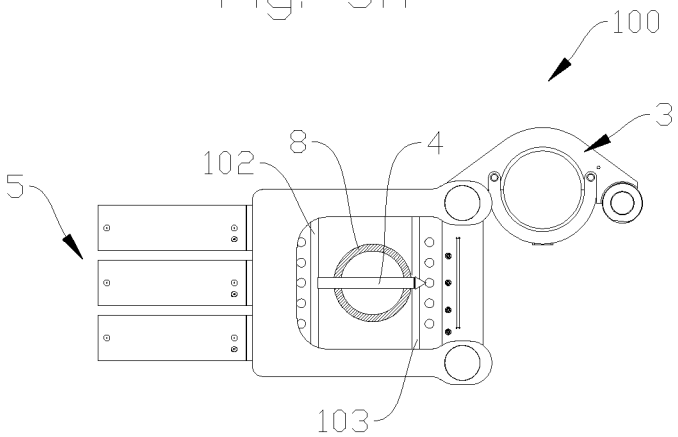
FIG. 5B shows, in a smaller scale than FIG. 5A, a plane view of the combined pinning and cutting tool.

FIG. 5B shows an example of a tubular structure 8 that has been pinned and is ready to be cut. As can be seen from FIG. 5B, the tubular structure 8 is positioned closer to the actuators 5 as compared to when the tubular structure 8 is held by the reaction member 3 used for pinning. This is due to the limitation in stroke of the piston rods 52. To enable the cutting blades 102, 103 to fully cut through the tubular structure 8 within the stroke of the piston rods 52, the tubular structure must be positioned closer to the first cutting blade 102.

From FIG. 5B it can also be seen that the cutting blades 102, 103 are positioned at a lower elevation than the pin 4 to prevent the pin 4 from restricting the cutting operation. It can also be seen that the reaction member 3 used for pinning is opened in FIG. 5B, as compared to closed in FIG. 5A. In FIG. 5A the second enveloping element 34 is also removed. Whether the reaction member 3 is opened or closed has no effect on the cutting operation. One or the other may be desirable for practical reasons.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A pinning tool for pinning a tubular structure by pressing a pin through a sidewall of the tubular structure, the pinning tool comprising:

a tool body configured for receiving the tubular structure;

an actuator mounted on the tool body, the actuator being provided with a piston rod, wherein the actuator is configured for displacing the piston rod in a translational movement;

a pin adaptor releasably coupled to the piston rod of the actuator and being configured for receiving and releasably holding the pin to be pressed through and remain in the sidewall of the tubular structure, and a reaction member for fixing a relative position between the tool body and the tubular structure during pinning, wherein the translational movement of the piston rod causes displacement of the pin adaptor, thereby pressing, in operational use, the pin through the sidewall of the tubular structure.

2. The pinning tool according to claim 1, wherein the actuator, the pin adaptor and the tool body are arranged such that, in operational use when the pin is provided on and held by the pin adaptor, the pin penetrates through the sidewall, wherein a longitudinal axis of the pin is substantially parallel to a direction of the translational movement.

3. The pinning tool according to claim 1, wherein the pin is provided on and held by the pin adaptor.

4. The pinning tool according to claim 3, wherein the pin is provided with a projection extending helically about the longitudinal axis.

5. The pinning tool according to claim 3, wherein a first end portion of the pin is replaceable.

6. The pinning tool according to claim 1, wherein a position of the pin adaptor relative to the tubular structure is adjustable in a transverse direction orthogonal to the longitudinal axis.

7. The pinning tool according to claim 1, wherein the reaction member is hinged to the tool body, and, in a closed position, enveloping the tubular structure.

8. A combined pinning and cutting tool for pinning and cutting a tubular structure, the combined pinning and cutting tool comprising:

a pinning tool comprising:

a tool body configured for receiving the tubular structure;

an actuator mounted on the tool body, the actuator being provided with a piston rod, wherein the actuator is configured for displacing the piston rod in a translational movement;

a pin adaptor releasably coupled to the piston rod of the actuator and being configured for receiving and releasably holding a pin to be pressed through and remain in a sidewall of the tubular structure, and a reaction member for fixing a relative position between the tool body and the tubular structure during pinning, wherein the translational movement of the piston rod causes displacement of the pin adaptor, thereby pressing, in operational use, the pin through the sidewall of the tubular structure;

a non-rotatable cutting element connected to the piston rod; and a second reaction member for applying a reaction force on the tubular structure during cutting.

9. The combined pinning and cutting tool according to claim 8, wherein the second reaction member is hinged to the tool body and comprises a second cutting element directed towards, in an operational position, the non-rotatable cutting element for facilitating the cutting.

10. A method for pinning a tubular structure via a pinning tool, the pinning tool comprising:

a tool body configured for receiving the tubular structure;

an actuator mounted on the tool body, the actuator being provided with a piston rod, wherein the actuator is configured for displacing the piston rod in a translational movement;

a pin adaptor releasably coupled to the piston rod of the actuator and being configured for receiving and releasably holding a pin to be pressed through and remain in a sidewall of the tubular structure, and a reaction member for fixing a relative position between the tool body and the tubular structure during pinning, wherein the translational movement of the piston rod causes displacement of the pin adaptor, thereby pressing, in operational use, the pin through the sidewall of the tubular structure;

the method comprising:

providing the pinning tool with a pin releasably held by the pin adaptor;

positioning the pinning tool adjacent the tubular structure;

fixing the position of the pinning tool relative to the tubular structure;

activating the pinning tool for pressing the pin through the sidewall of the tubular structure by carrying out the translational movement of the piston rod of the actuator, and releasing the pin from the pin adaptor.

11. The method according to claim 10, wherein, in the step of positioning the pinning tool, the positioning comprises adjusting a position of the pin adaptor relative to the tubular structure in a transverse direction orthogonal to the longitudinal axis.

12. The pinning tool according to claim 4, wherein a first end portion of the pin is replaceable.

* * * * *